US005716076A

United States Patent [19]

Tamborini et al.

[11] Patent Number: 5,716,076

[45] Date of Patent: Feb. 10, 1998

[54] FITTING ASSEMBLY FOR SUCTION WASHING MACHINES FOR CLEANING FLOORS, MOQUETTES AND CARPETS

[76] Inventors: Ariberto Tamborini; Giancarlo Tamborini, both of Via XXV Aprile, 16, 21020 Daverio (VA), Italy

[21] Appl. No.: 590,626

[22] Filed: Jan. 24, 1996

[30] Foreign Application Priority Data

Jan. 30, 1995 [IT] Italy ..... MI95A0149

[51] Int. Cl.[6] ..... A47C 7/00

[52] U.S. Cl. ..... 285/7; 285/402; 285/124.1; 15/321

[58] Field of Search ..... 15/321, 322; 285/7, 285/137.1, 402

[56] References Cited

U.S. PATENT DOCUMENTS

| | | | |
|---|---|---|---|
| 3,962,745 | 6/1976 | Collier | 285/7 |
| 4,083,077 | 4/1978 | Knight et al. | 285/7 |
| 4,753,268 | 6/1988 | Palav | 285/137.1 |
| 4,900,065 | 2/1990 | Nouck | 285/137.1 |
| 4,982,736 | 1/1991 | Schneider | 285/137.1 |
| 5,022,461 | 6/1991 | Potier et al. | 285/137.1 |
| 5,459,901 | 10/1995 | Blase et al. | 15/321 |
| 5,555,597 | 9/1996 | Berfield | 15/321 |
| 5,561,884 | 10/1996 | Nijland et al. | 15/321 |
| 5,613,271 | 3/1997 | Thomas | 15/321 |

*Primary Examiner*—Eric K. Nicholson
*Attorney, Agent, or Firm*—Bucknam and Archer

[57] ABSTRACT

The present invention relates to a fitting assembly for suction-washing machines, for cleaning floors, moquettes, carpets and the like. The fitting assembly comprises at least two tubular lengths, which are mutually removably coaxially associated with one another, each of which is provided with a body in which are provided a suction duct and a delivery duct which are parallel to one another.

One of the tubular length is provided with a tapering end portions, which can be introduced into an end portion of the other tubular length; at one end portion of the delivery duct of a tubular length are provided connecting means, which can be removably tightly engaged with the end portion of the delivery duct of the other tubular length as the two tubular lengths are connected; the fitting assembly comprising, moreover, an end connecting element which can be coupled to end fittings having different diameter inlets.

4 Claims, 4 Drawing Sheets

FITTING ASSEMBLY FOR SUCTION WASHING MACHINES FOR CLEANING FLOORS, MOQUETTES AND CARPETS

BACKGROUND OF THE INVENTION

The present invention relates to a fitting assembly for suction-washing machines for cleaning floors, moquettes, carpets and the like.

Suction-washing machines for cleaning floors, moquettes, carpets or the like are already known.

These prior machines usually comprise a supporting box-like construction, which is mounted on wheels to be easily driven during the use thereof, in which a suction device and a pump are arranged, said pump being coupled, by the delivery duct thereof, to a tank containing a cleaning liquid.

From the above mentioned box-like construction, a tube extends, comprising generally a flexible hose, of a plastic material reinforced by inner reinforcement coils, of steel or other high strength material, by means of which the pump and suction device or aspirator are coupled to end fittings for supplying the cleaning fluid and sucking the delivered liquid as well as the removed dirty material.

The flexible hose is provided, in its inside, with a suction duct and a delivery duct, of less diameter, and being constituted by two different diameter tubular bodies, which are arranged adjoining one another and coupled to one another by clamping elements which are mutually spaced or encompassed by a tubular sheath.

In order to allow an user to remain with an upright position during the handling of such an apparatus, these machines are conventionally also provided with extension tubes, of a rigid or semirigid material, which are arranged between a flexible hose, which is necessary for providing a high handling capability, and the end fitting elements.

Also the extension tubes or pipes are provided with a suction duct and a delivery duct, which are respectively coupled to the suction and delivery ducts of the flexible hose.

The above mentioned prior suction-washing machines, however, are affected by drawbacks mainly relating to a great difficulty of properly assembling the extension pipes and connecting them to the flexible hose, since these operations are very complex and do not always provide a reliably connection of the several component elements of the machine.

Moreover, the provision of the extension tubes or pipes is very expensive, mainly with respect to the coupling between the tubular body, in which the suction duct is arranged, and the tubular duct, in which is arranged the delivery duct.

Another drawback of the prior suction-washing machines, is constituted by the difficulty of properly coupling to the flexible hose or to the extension tube, the several end fittings which, very frequently, have inlets of different diameters.

SUMMARY OF THE INVENTION

Accordingly, the aim of the present invention is to overcome the above mentioned problems, by providing a fitting assembly for suction-washing machines, which can be easily assembled and which is suitable to fully meet the several different using requirements of the machine.

Within the scope of the above mentioned aim, a main object of the present invention is to provide a machine of the above mentioned type which includes an extension pipe which can be made in a very simple manner and is provided with high tightness properties.

Another object of the present invention is to provide such a fitting assembly allowing to greatly simplify the coupling of several different end fittings either to the flexible hose or to the extension pipe of the suction-washing machine.

According to one aspect of the present invention, the above mentioned aim and objects, as well as yet other objects, which will become more apparent hereinafter, are achieved by a fitting assembly for suction-washing machines, for cleaning floors, moquettes, carpets and the like, characterized in that said fitting assembly comprises at least two tubular lengths, which can be mutually coaxially removably coupled, and each of which is provided with a body in which a parallel suction duct and a delivery duct are provided.

One of the tubular lengths is provided with a tapering end portion which can be engaged in an end portion of the other tubular length; at one end portion of the delivery duct of a tubular length being provided coupled means which can be tightly removably engaged with the end portion of the delivery duct of the other tubular length, as the two tubular lengths are coupled to one another.

BRIEF DESCRIPTION OF THE DRAWINGS

Further characteristics and advantages of the invention will become more apparent hereinafter from the following detailed disclosure of a preferred, though not exclusive, embodiment of the fitting assembly according to the invention which is illustrated, by way of an indicative, but not limitative, example in the figures of the accompanying drawings, where.

DESCRIPTION OF THE PREFERRED EMBODIMENTS

Figure 1:
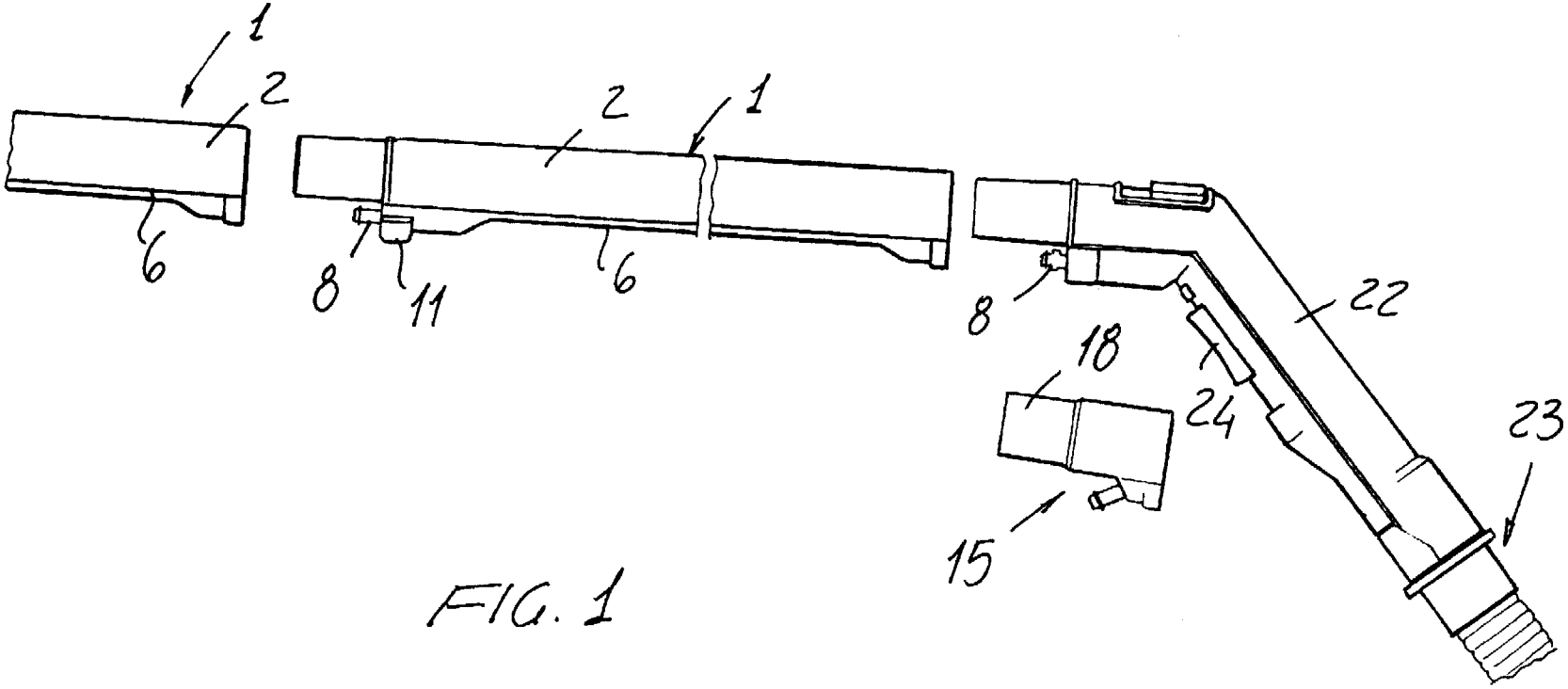
FIG. 1 is a schematic view illustrating the end length of the flexible hose of a suction-washing machine, and also illustrating some of the fittings therefor.
Figure 2:
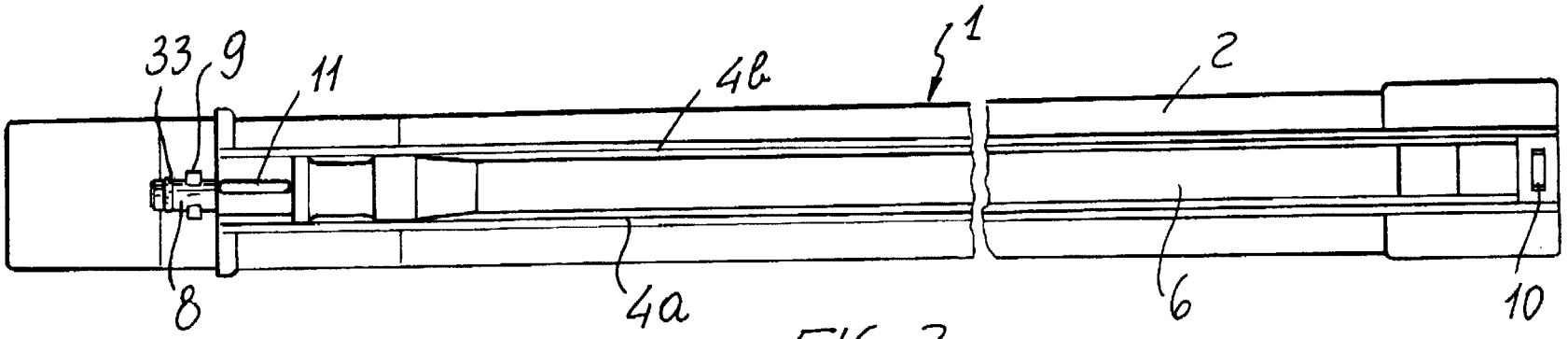
FIG. 2 is a bottom plan view illustrating a tubular length of an extension pipe.
Figure 3:
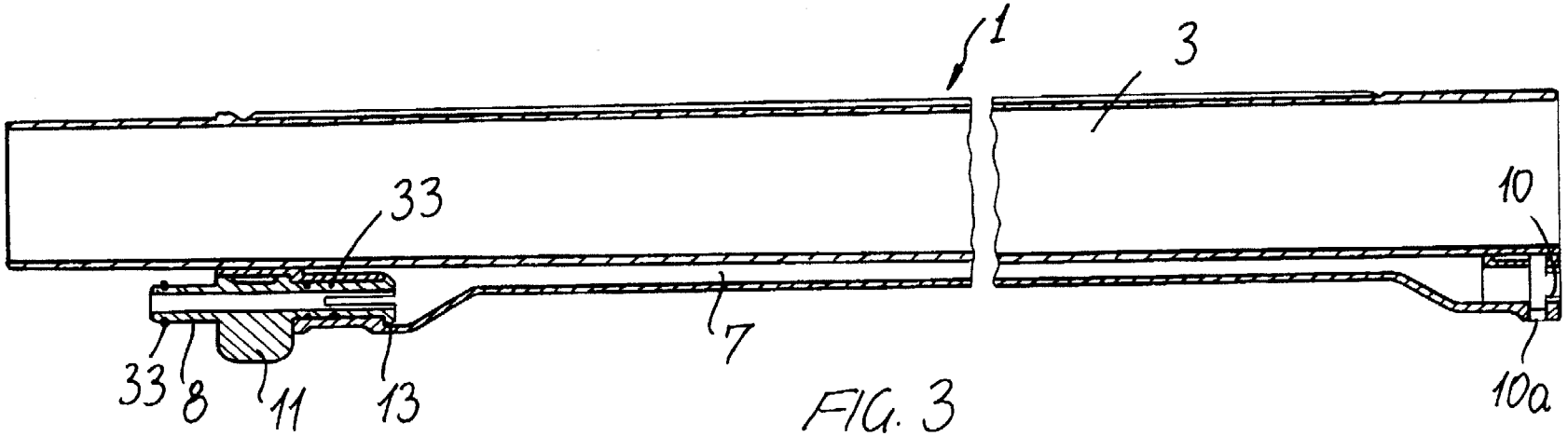
FIG. 3 is an axial cross sectional view illustrating the tubular length shown in FIG. 2.
Figure 6:
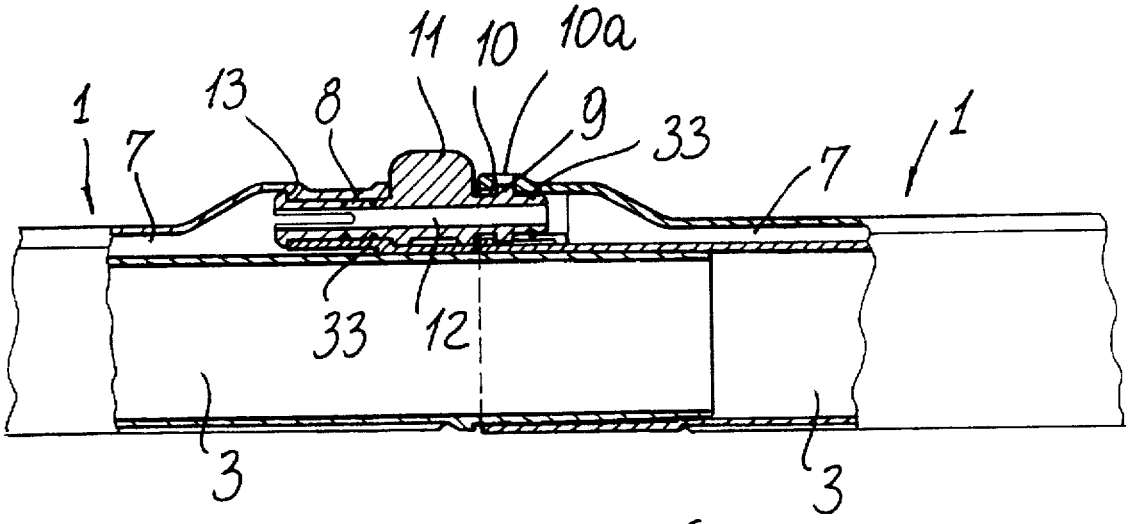
FIG. 6 illustrates two tubular lengths of the extension pipe, which are mutually coupled and shown in cross section at their connection region.
Figure 4:
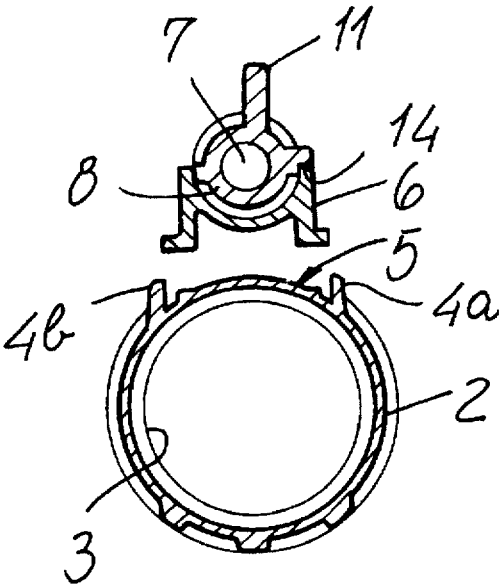
FIG. 4 is a cross sectional view illustrating the tubular length of the preceding figures, some components being shown by an exploded view.
Figure 5:
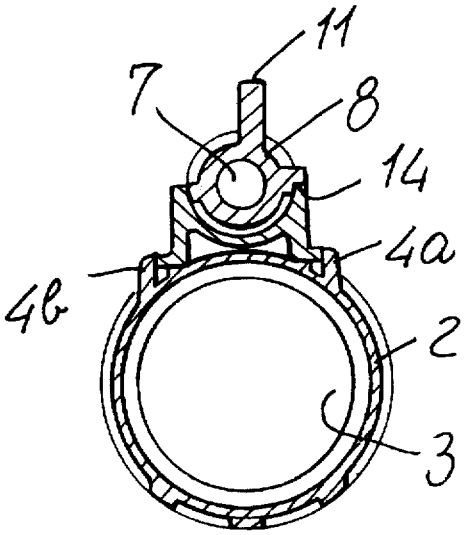
FIG. 5 is a cross sectional view illustrating the above mentioned tubular length.
Figure 7:
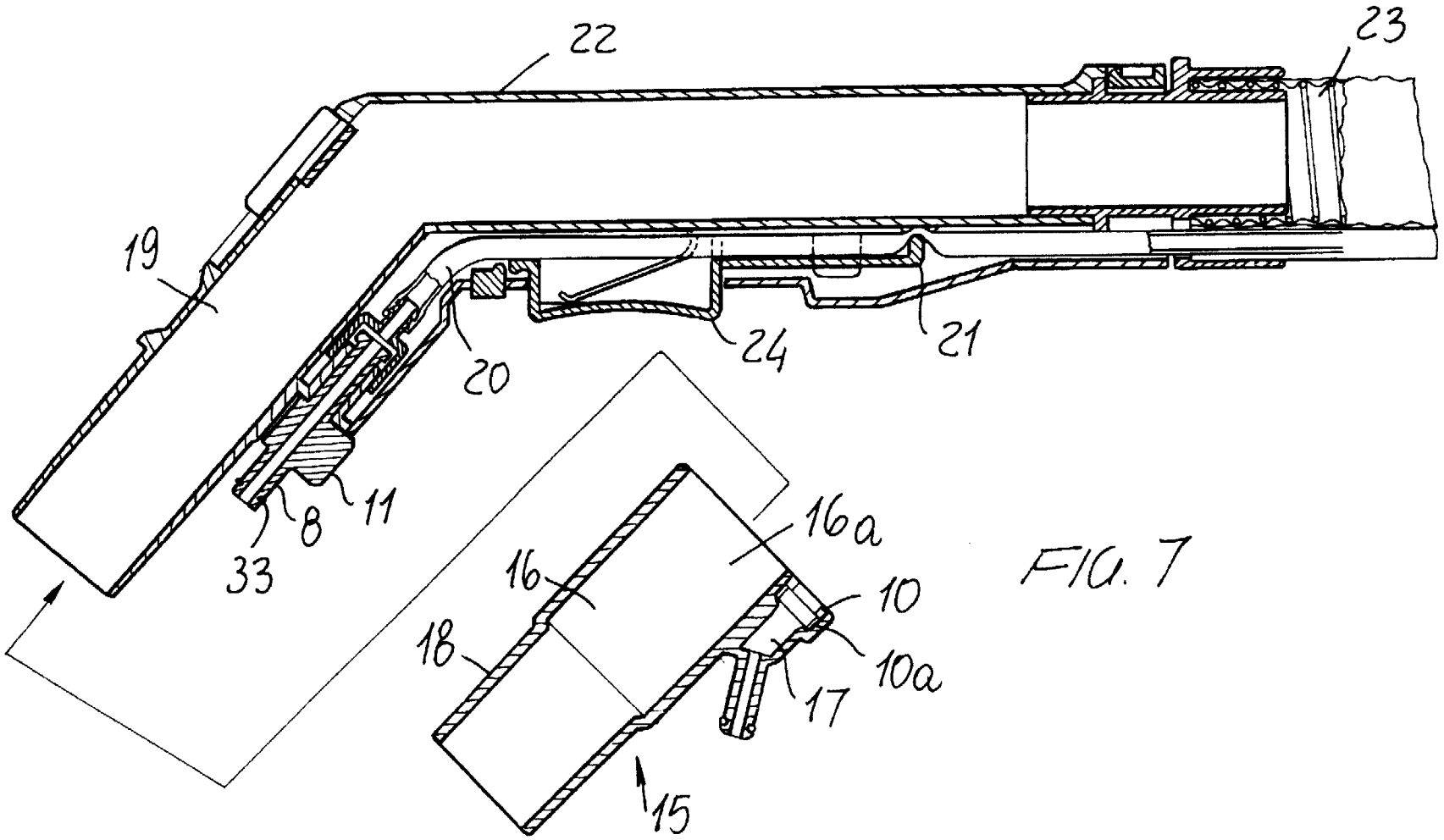
FIG. 7 is an axial cross-sectional view illustrating and end portion of the flexible hose and an end fitting or connecting element.

With reference to the number references of the figures of the accompanying drawings, the fitting assembly according to the present invention comprises an extension pipe, constituted by one or more tubular lengths 1, which are removably associated with the end portion 22 of a flexible hose 23 of the suction-washing machines and to end fittings for supplying a cleaning liquid and for sucking the cleaning liquid and the dirty material removed from the surface being cleaned.

As shown, the tubular length 1 is constituted by a main body 2, which is made of a suitable stiffness thermosealable plastic material, in which a suction duct 3 is provided.

On the mantle thereof, the main body 2 is provided with a pair of fins 4a and 4b which laterally define a longitudinal recess 5 in which is engaged a secondary body 6 in which a delivery duct 7 is formed, said delivery duct having a diameter smaller than the diameter of the suction duct 3.

The secondary body 6 is coupled to the main body by means of a thermosealed connection, which is preferably performed at the fins 4a and 4b, for example by contacting a hot blade element.

The end portion of the main body 2 of a tubular length is suitably tapered and can be introduced into the axial end portion of another tubular length 1; at one end portion of a delivery duct 7 are provided coupling means which can be tightly removably engaged with the end portion of the delivery duct 7 of the other tubular length, as the two tubular lengths 1 are connected.

These coupling means are preferably constituted by a bayonet clutch-element.

More specifically, the bayonet clutch-element comprises a pin 8 which is rotatably introduced, by an end portion thereof, into an end portion of the delivery duct 7 of a tubular length 1.

A portion of said pin 8 projects from the delivery duct 7 of a tubular length 1 and extends in the direction of the end portion of the main body 2 of the tubular length 1, provided for engaging within the other tubular length 1.

That portion of the pin 8 projecting from the delivery duct 7 of a tubular length 1 can be introduced into the end portion of the delivery duct 7 of the tubular length 1 provided to be connected to the pin 8 bearing tubular length.

Near the end portion thereof to be introduced into the delivery duct of the other tubular length, the pin 8 is provided with tooth element 9 projecting from its outer mantle and which are angularly spaced from one another about the axis of the pin 8.

The mentioned tooth element 9, in particular, can be engaged in recesses 10 provided on the delivery duct of the other tubular length and ending with a respective cut-out 10a, therewith the tooth element 9 can be engaged, by causing the pin 8 to turn about its axis to provide a mutual connection of the two tubular lengths 1.

The pin 8 is moreover provided with a pin portion which, as the two tubular lengths have been mutually connected, will be arranged outside both of the delivery duct 7 of a tubular and of the delivery duct 7 of the other tubular length. On this portion is provided a fin 11 which can be handled by the user in order to cause the pin 8 to turn about the axis thereof, in order to either engage or disengage the tooth elements 9 with/from the cut-out 10a and, accordingly, to either connect or disengage the two tubular lengths.

The pin 8, as shown, is moreover provided with an axial hole 12 to connect the delivery ducts 7 of the two assembled tubular lengths.

The pin 8 is also provided, at one end portion thereof opposite to the tooth element 9 bearing end portion, with further tooth elements 13, for snap engaging the pin 8 inside the delivery duct 7 of a tubular length, therewith the pin 8 will be assembled during the making process.

Advantageously, along the extension of the pin 8 are provided sealing ring elements 33, engaging with the walls of the delivery ducts 7 of the two tubular lengths, so as to provide a satisfactory sealing to the assembled tubular lengths.

The pin 8 can furthermore be provided, on its outer surface, with a sealing shoulder 14, for limiting the rotary movement of said pin about the rotary axis thereof, for engaging or disengaging the tooth elements 9 with/from the cut-outs 10a of the recesses 10.

The fitting assembly according to the present invention comprises moreover and end fitting 15 inside which are provided, as disclosed with reference to the extension pipe, a suction duct 16 and a delivery duct 17.

The suction duct 16 is provided, in turn, at an axial end portion of the end fitting, with an inlet 16a which can be associated with the end portion 22 of the flexible hose 23 or with an end portion of the extension pipe.

The end fitting 15 is provided, near the end portion thereof opposite to the inlet 16a, with a tapering region 18, preferably of frustum of cone shape, provided for engaging with the inlet of end fitting having mutually different diameters.

The inlet of the delivery duct 17 of the end fitting is suitably provided with recesses analogous to the recesses 10, i.e. including a cut-out portion 10a, which have been also indicated by the same reference numbers, so as to allow the insertion of the end portion of the pin 8, with the tooth element 9, of the extension pipe inside said recesses, as the end fitting 15 is connected to the extension pipe.

Also the end portion 22 of the flexible duct or hose 23 is provided, in its inside, with a suction duct 19 and a delivery duct 20.

The end region of the end portion 22 opposite to the end portion coupled to the flexible hose 23 is suitably tapered and can be introduced into one end portion of the tubular lengths 1 constituting the extension type or into the inlet 16a of the end fitting 15.

Also at the end portion of the delivery duct 20 arranged near the end of the end portion 22 opposite to the flexible hose 23 can be provided a pin, made likewise the above disclosed pin 8, and which has also been indicated by the same reference number.

Thus, also the connection of the end portion 22 of the flexible hose 23 with the extension pipe constituted by the tubular lengths 1, as well as with the end fitting 15, can be performed by coupling the pin 8, arranged on the end portion 22, and the cut-out recesses 10 as formed in the delivery ducts of the end fitting 15 or of the tubular lengths 1 of the extension pipe.

To the foregoing it is to be further added that the delivery duct 20, which extends inside the end portion 22 of the flexible hose 23, is provided with a resiliently yielding portion, thereon a lever 21 operates, said lever being controlled through a push-button 24 by means of which it is possible to shut-off the delivery of the cleaning liquid.

The assembling of the fitting assembly according to the present invention will be self-evident from the above disclosure.

More specifically, it should be apparent that the extension pipe can be easily assembled by simply associating with one another the several tubular lengths 1 by introducing an end portion of a tubular length into the inlet of the suction duct of the adjoining tubular length and by introducing the end portion of the pin 8 supported by a tubular length, into the recess 10 defined in the inlet of the delivery duct 7 of the adjoining tubular length. The coupling will be then locked by simply turning the pin 9 about its rotary axis, by operating the fin 11.

That same operation can also be performed for coupling the extension pipe to the end portion 22 of the flexible hose 23, or to connect the extension type to the end fitting 15, or to connect the end fitting 15 to the end portion 22 of the flexible hose.

In each case, the coupling performed by the pins 8 will provide a very satisfactory sealing and will operate to efficiently prevent the connected element from being disengaged.

From the above disclosure and from an observation of the figures of the accompanying drawings, it should be apparent that the invention fully achieves the intended aim and objects.

In particular, the fact is to be pointed out that a fitting assembly for suction-washing machines has been provided which can be assembled in a very quick and simple manner so as to meet all of the different use requirements.

The invention, as disclosed, is susceptible to several variations and modifications, all of which will come within the scope of the invention.

Moreover, all of the details can be replaced by other technically equivalent elements.

In practicing the invention, the used materials, provided that they are compatible to the intended use, as well as the contingent size and shapes, can be any, depending on requirements,

We claim:

1. A fitting assembly for suction-washing machines, for cleaning floors, moquettes and carpets, characterized in that said fitting assembly comprises at least two tubular lengths, which can be removably coaxially associated with one another, each of said tubular lengths including a body, in which parallel suction and delivery ducts are provided, one of said two tubular lengths having a tapering end portion which can be introduced into an end portion of the other tubular length, at one end portion of a said delivery duct of said one tubular length being provided coupling means which can be tightly removably engaged with an end portion of the delivery duct of the other tubular length, as said two tubular lengths are connected to one another, wherein said coupling means comprise a bayonet clutch element comprising a pin rotatably engaged in one end portion of said delivery duct of said tubular length, said pin being provided with a projecting portion which projects from said delivery duct and which can be partially introduced into said delivery duct of said other tubular length and being provided on an outside thereof with tooth elements which can be engaged in, or disengaged from, by partially causing said pin to turn about a rotary axis thereof, recesses provided in said delivery duct of said other tubular length, said pin being axially perforated for coupling said delivery ducts of said two tubular lengths.

2. A fitting assembly, according to claim 1, in which said pin is provided, at an intermediate region thereof, provided for being arranged outside of the delivery ducts of the two tubular lengths mutually connected, with a driving fin, for causing said pin to be rotated.

3. A fitting assembly, according to claim 1, wherein said pin is provided, in a region thereof engaged with said one delivery duct and at a region thereof engaged with said other delivery duct, with sealing gaskets.

4. A fitting assembly, according to claim 1, comprising and extension pipe, constituted by at least a tubular length, including a main body of a thermosealable plastic material provided with an inner suction duct and formed, on an outer surface thereof, with a longitudinal recess in which a plastic material secondary body thermosealed to said main body is arranged, wherein said longitudinal recess is transversely delimited by a pair of fins where said secondary body is thermosealed to said main body.

* * * * *